US006092395A

United States Patent [19]

Revill

[11] Patent Number: 6,092,395

[45] Date of Patent: Jul. 25, 2000

[54] CIRCULAR WARP THREAD KNITTING MACHINES

[75] Inventor: Stuart Baird Revill, Swadlincote, United Kingdom

[73] Assignee: Trunature Limited, United Kingdom

[21] Appl. No.: 09/388,117

[22] Filed: Sep. 1, 1999

[30] Foreign Application Priority Data

Oct. 24, 1998 [GB] United Kingdom ..... 9823241
Feb. 12, 1999 [GB] United Kingdom ..... 9903069

[51] Int. Cl.[7] ..... D04B 25/02

[52] U.S. Cl. ..... 66/81; 66/8

[58] Field of Search ..... 66/79, 81, 133, 66/125 R, 141, 146, 10, 8

[56] References Cited

U.S. PATENT DOCUMENTS

| | | | |
|---|---|---|---|
| 2,166,494 | 7/1939 | Hiller | 66/81 |
| 3,570,268 | 3/1971 | Nogues | 66/81 |
| 3,693,378 | 9/1972 | Nogues | 66/81 |

FOREIGN PATENT DOCUMENTS

| | | | |
|---|---|---|---|
| 519751 | 1/1921 | France | 66/81 |
| 1461788 | 6/1989 | U.S.S.R. . | |
| 2057020 | 3/1981 | United Kingdom | 66/81 |
| 2 210 632 | 6/1989 | United Kingdom . | |
| 2 214 198 | 8/1989 | United Kingdom . | |

*Primary Examiner*—Danny Worrell
*Attorney, Agent, or Firm*—Quarles & Brady LLP

[57] ABSTRACT

In a high speed circular warp thread knitting machine latch needles are reciprocated in respective, vertical tricks in a stationary cylinder by a cam rotating around the cylinder thereby to engage warp threads drawn down from above. A presser plate rotating with the cam deflects each warp thread in turn across a needle while the latch of the latter is open. According to the invention each warp thread descends uninterruptedly to a respective needle trick from an eyeleted disc at an acute angle to the vertical and the presser plate has a leading surface which extends forwardly and toward the cylinder at an acute angle to a radius of the cylinder. In a preferred embodiment a wire latch guard extends forwardly from and moves with the presser plate so that its free end is positioned to obstruct closing movement of the latch of a rising needle just as the latch is released by casting off the previously formed loop of thread onto the shank of the needle.

10 Claims, 4 Drawing Sheets

CIRCULAR WARP THREAD KNITTING MACHINES

FIELD OF THE INVENTION

This invention relates to improvements in high speed circular warp thread knitting machines of the kind in which latch needles are reciprocated in respective, vertical tricks in a stationary cylinder by rotating cams thereby to engage warp threads drawn down from above, a presser plate rotating with the cams being provided to deflect each warp thread across a needle while the latch of the latter is open.

BACKGROUND OF THE INVENTION

A machine of this kind is disclosed in the Specification of British Patent No. GB-B-2214198. According to that Specification descending warp threads 12 pass through respective wire guides 34 which, with the cylindrical surface of the knitting head to which they are secured, form individual, approximately sector-shaped apertures above the needle tricks. The descending warp threads are deflected by the apertures on their way to the respective needle tricks and they are moved across the wire guides by the presser plate or placing element 38 in order to be engaged by the needle hooks.

The provision of the guides 34 limits the number of needle tricks which can be provided in a given cylinder. The present Applicants have discovered that if warp threads approach the cylinder at an appropriate angle and if the presser plate is appropriately shaped and positioned there is no necessity to surround each warp thread with such a guide. Dispensing with these guides permits the use of up to twice as many needles in the same machine, thus permitting the manufacture of a more closely or densely knit product without any detriment to the speed and efficiency of the operation. The machine of the present invention is simpler, utilises less components and is easier to maintain.

A long-standing problem associated with the use of such machines is that as a needle rises sufficiently for its latch to cast off onto the stem of the needle the loop of warp thread which has just been formed the latch will tend to close with great violence before it is intended to close, i.e. before it is closed by the said loop as the needle later descends. Due to the high speed of the machine and the energy accumulated in the latch before it is released the latter can bounce between closed and open positions and in the worst case may be closed when a warp thread is passed around the needle by the presser plate, so that a stitch cannot be formed.

SUMMARY OF THE INVENTION

At best the latch needles experience severe wear necessitating their early replacement.

A principal object of the present invention is therefore to improve upon the machine disclosed in the Specification of British Patent No. GB-B-2214198.

In accordance with the present invention there is provided a high speed circular warp thread knitting machine of the kind in which latch needles are reciprocated in respective, vertical tricks in a stationary cylinder by rotating cam means thereby to engage warp threads drawn down from above, a presser plate rotating with a said cam means being provided to deflect each warp thread in turn inwardly of the cylinder across a needle while the latch of the latter is open, wherein the warp threads are drawn through respective guides in a stationary element mounted above the cylinder, the angular relationship of said element to the cylinder being such that each guide is angularly offset relative to the associated needle trick in the direction opposite to the intended direction of rotation of the presser plate, the presser plate having a leading surface presented toward the cylinder at an acute angle to a radius of the cylinder and the arrangement being such that, when not deflected by the presser plate, each warp thread passes inwardly of the cylinder in a straight line at an acute angle to the vertical between the associated guide and the top of the associated needle trick without passing through or around any other thread guidance or deflection means.

The said element is preferably a horizontal disc mounted above and concentric with the cylinder, said guides being eyelets having substantially vertical axes and being formed near the periphery of the disc.

Preferably the eyelets lie on a circle of greater diameter than the cylinder.

One or both of said acute angles may be in the region of 5°.

A latch guard is preferably provided positioned to obstruct closing movement of the latch of an ascending needle just after the latch has cast off onto the stem of the needle a previously formed loop.

The latch guard is preferably of wire.

Preferably the latch guard moves with the presser plate and extends forwardly therefrom in the direction of rotary movement of the latter a distance such that when the presser plate is deflecting a warp thread around a descending needle the leading end of the latch guard will obstruct closure of the latch of a rising needle the latch of which has just cleared a previously formed loop.

The presser plate may be mounted on top of a column extending vertically from and movable with a cam box included in said cam means and the latch guard may be supported below the presser plate by columns mounted upon the same said cam box.

The latch guard is preferably arcuate, the arc lying on a circle concentric with the cylinder.

One or more additional latch guards may be provided spaced vertically from said first-mentioned latch guard.

BRIEF DESCRIPTION OF THE DRAWINGS

A preferred embodiment of the present invention will now be described with reference to the accompanying diagrammatic drawings, in which.

DETAILED DESCRIPTION OF THE DRAWINGS

Figure 1:
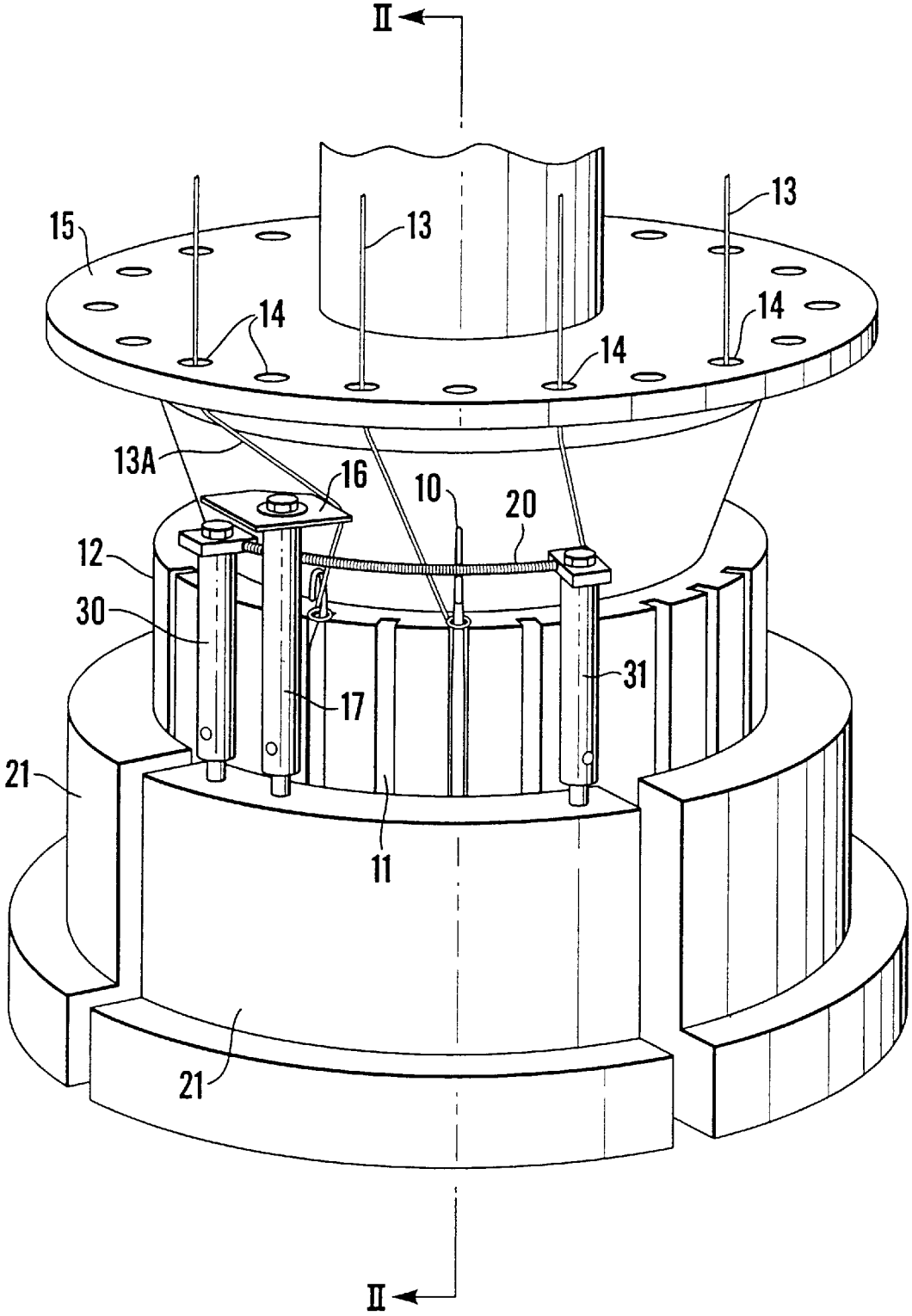
FIG. 1 is an isometric view of a high speed warp thread circular knitting machine in accordance with the present invention.
Figure 2:
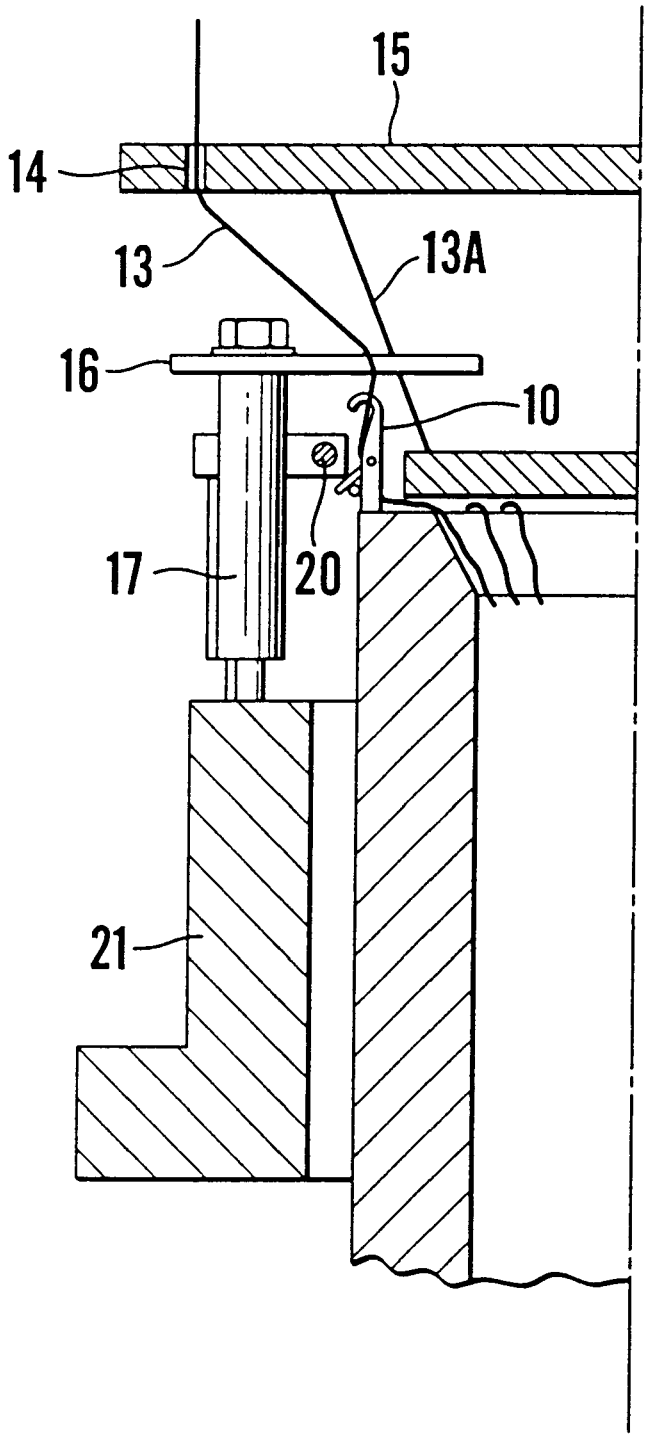
FIG. 2 is a sectional elevation taken generally on the line II—II of FIG. 1.

The machine illustrated is of a kind used for the high speed knitting of a continuous tube or sock of mesh. Machines of this kind are exemplified, for example, in GB-B-2214198 so that no detailed description is considered necessary except to say that latch needles 10 are reciprocated vertically in respective tricks or grooves 11 in a stationary cylinder 12 by rotating cam boxes 21 arranged around the cylinder. The cam boxes have respective cam profiles (not shown) which cause reciprocation of the needles. Typically six cam boxes surround the cylinder 12 in circumferentially spaced relation, and different cam box sections may present different cam profiles to accommodate the introduction into the knitted product at circumferentially spaced positions of a weft thread. The manner in which this is done is known per se and forms no part of the present invention and will therefore not be further described. The knitted tubular product or sock passes from the tops of the needle tricks 11 downwardly through the centre of the cylinder 12.

Warp threads 13 are brought down to the needles from above through respective, eyelets 14 having generally vertical axes and formed near the periphery of a stationary, horizontal disc 15 above and concentric with the cylinder 12. One, two or more threads may pass through each eyelet. Each eyelet 14 is of a diameter only just great enough to allow the respective warp thread or combination of warp threads 13 to pass through without substantial friction but without play.

Figure 3:
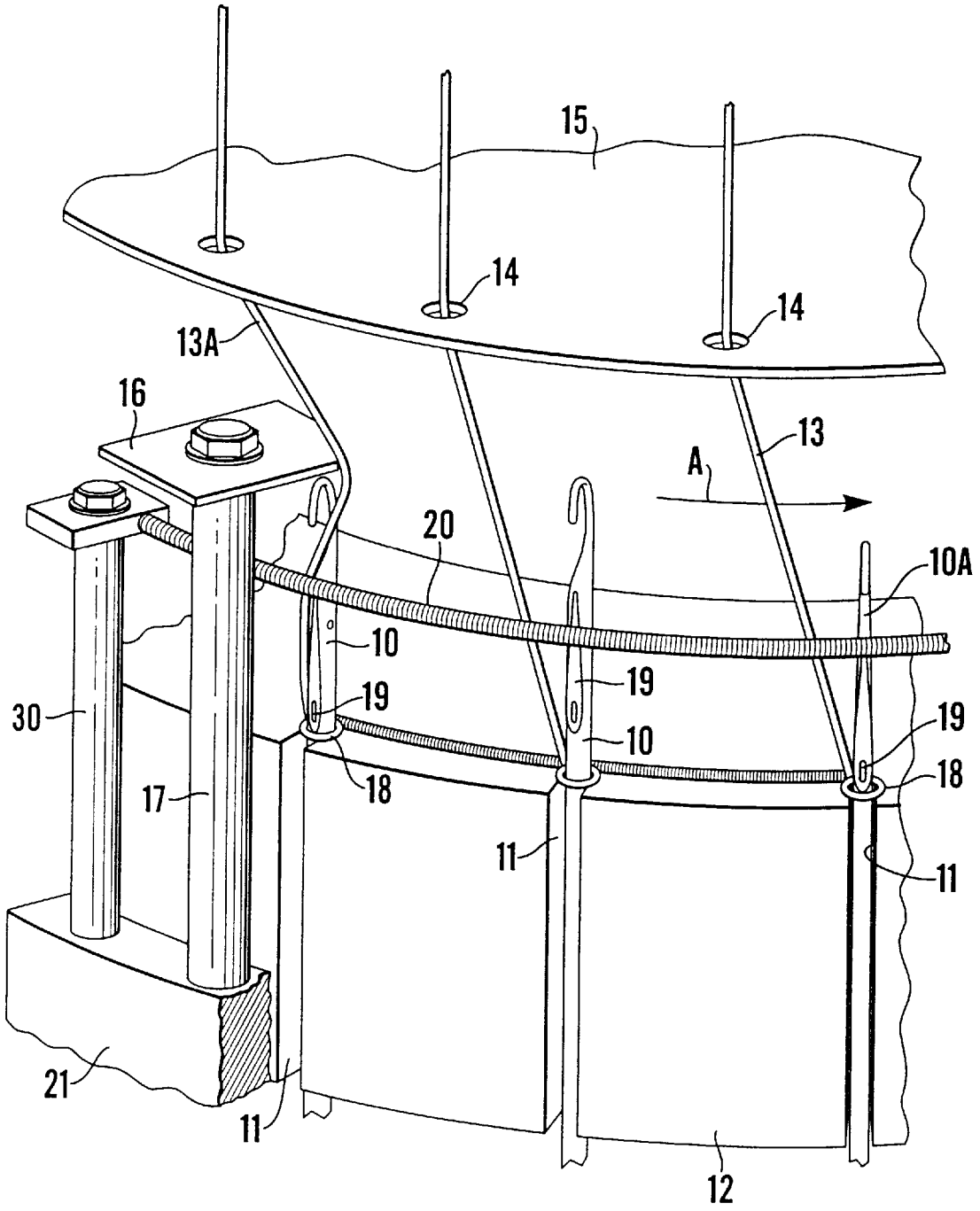
FIG. 3 is a view similar to FIG. 1 but on a larger scale and with parts removed for clarity.

A presser plate 16 is mounted on top of a column 17 which rises from one of the cam box section 21 and rotates therewith in the direction indicated by arrow A in FIG. 3. In accordance with the present invention the disc 15 is angularly related to the cylinder 12 such that each eyelet 14 is angularly offset from the associated needle trick 11 so that each warp thread 13 descends at an acute angle to the vertical. This angle of descent will depend upon the height above cylinder 12 of disc 15 and the extent of the angular offset and an optimum angle can be determined by trial and error for a given machine, but in one example of the invention this angle is in the region of 5°. Because the array of eyelets 14 of disc 15 is of greater diameter than the cylinder 12 the threads 13 also descend toward the cylinder.

Figure 4:
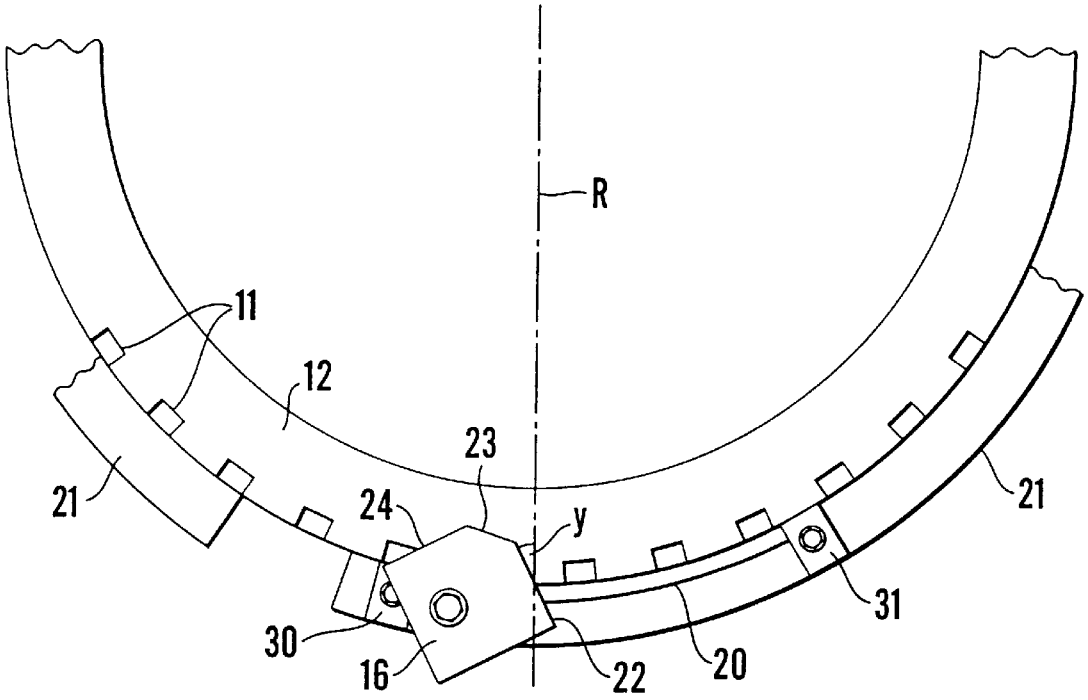
FIG. 4 is a partial plan view of the machine of FIG. 1 with the disc 15 removed.
Figure 5:
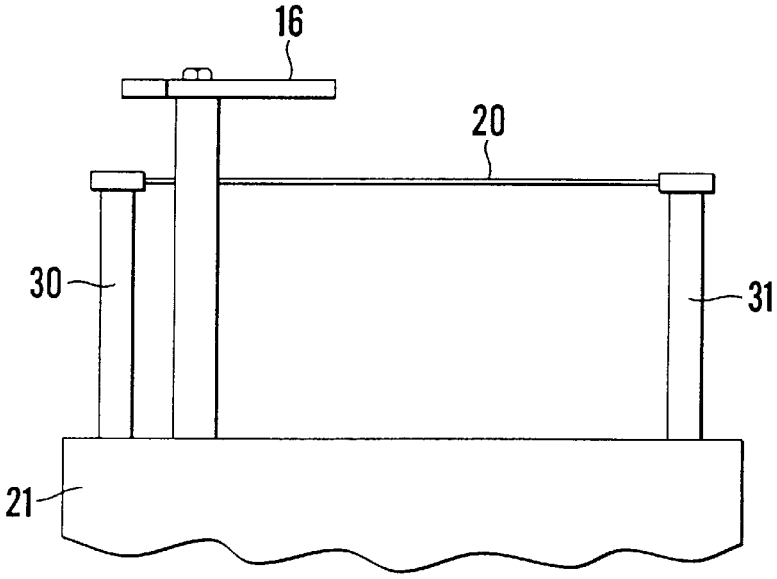
FIG. 5 is a partial sectional elevation showing the presser plate and latch guard of FIGS. 1 and 2 mounted on a respective cam box.

Referring to FIG. 4, the presser plate 16 is shaped and positioned so as to have a leading surface 22 facing inwardly of cylinder 12. The surface 22 forms with a radius R of the cylinder 12 an acute angle y of approximately 5°. At its inner end surface 22 merges with a chamfer surface 23 making a substantially greater angle with radius R and this in turn merges with an inner surface 24 which extends away from the cylinder.

The presser plate 16 deflects each warp thread 13 in turn inwardly of the cylinder so as to wrap it around a needle 10 as the latter begins to descend, as can best be seen in the case of the warp thread 13A in FIG. 3. The deflected warp thread is thus engaged by the hook of the descending needle, and after the presser plate 16 has passed the loop 18 of warp thread previously made and now cast off onto the stem of the needle causes the latch to close. This permits the descending needle to pull a new loop through the old to form a stitch, after which the needle begins to ascend again. As it does so the loop within the needle opens the latch, and immediately before reaching the position of the needle 10A illustrated the loop is cast off the open latch onto the stem of the needle.

When this happens the suddenly freed latch 19, which has been under tension by the loop, will tend to fly to the raised, closed position before bouncing or falling back to the open position (in which it is shown in the case of all three needles illustrated). At best this gives rise to undesirable vibrations which upset the harmonics of the camming operation and causes excessive wear of the pivots of the needle latches, requiring frequent replacement of needles. At worst a latch may remain in the raised, closed position when the presser plate 16 attempts to deflect a warp thread into the hook of the needle, in which case a stitch will be lost. Of course there will then be no thread within the closed needle to reopen the latch, so that the needle concerned fails to make a subsequent stitch and may simply cease to participate in the knitting process. This will of course adversely affect the tube of mesh being knitted with the result that a considerable amount of material may have to be scrapped. The machine may be stopped as soon as the fault is observed but the resulting downtime while it is rectified badly interrupts the high speed production.

Therefore in accordance with a further aspect of the present invention a wire latch guard 20 is mounted on columns 30 and 31 upstanding from the same cam box 21 from which the column 17 upstands. The latch guard 20 extends forwardly of the presser plate 16 in the direction A in which the latter is intended to move. The wire 20 is arcuate on a circle which is concentric with the cylinder 12 and of slightly greater diameter. The linear extent of the guard 20 is such that, as the presser plate 16 is deflecting a warp thread around a descending needle 10, the leading end 21 of the guard will obstruct closing movement of the latch 19 of an ascending needle 10A which has just cast a loop 18 off the latch 19 onto the stem of the needle. As will be seen from the FIG. 3 this obstruction of the latch 19 continues while the needle completes its ascent and while it begins to descend and as a warp thread is wrapped around it by the presser plate 16. As soon as the column 30 has moved past a needle which now has a warp thread engaged in its hook the latch of the needle is no longer obstructed by the guard 20 and may be closed in the conventional way by the loop 18 around the stem of the needle as the needle completes its descent.

The wire of the guard 20 is preferably of rounded steel and preferably has a degree of resilience to cushion the impact against it of a needle latch.

One or more additional wire guards (not shown) may extend between the columns 30 and 31 in vertically spaced relation to the guard 20. A guard (not shown) lower than the guard 20 would obstruct the spoon of the latch of needle 10A earlier than the guard 20 and thus minimise any closing movement of the latch. A higher guard would ensure that a latch is restrained when its needle is at a maximum elevation.

The arrangement illustrated in which each latch guard 20, or series of latch guards, is mounted on a respective cam box 21 to move therewith is a convenient one but in an alternative embodiment of the invention (not shown) latch guards 20 are replaced by a single, horizontal, stationary annular latch guard which is suspended at the appropriate height from the disc 15.

References have been made throughout to a "circular" cylinder 12 and disc 15 but it will be understood that cam boxes may be made to rotate about a cylinder of any annular configuration. All that is necessary is that the array of eyelets 14 should have a similar configuration to that of the cylinder and preferably of greater cross-sectional area.

What is claimed is:

1. A high speed circular warp thread knitting machine comprising latch needles reciprocated in respective, vertical tricks in a stationary cylinder by rotating cam means adapted to engage warp threads drawn down from above, a presser plate rotating with said cam means to deflect each warp thread in turn inwardly of the cylinder across one of said latch needles while the latch of the latch needle is open, wherein warp threads are drawn through respective guides in a stationary element mounted above the cylinder, the angular relationship of said stationary element to the cylinder being such that each guide is angularly offset relative to the respective needle trick in a direction opposite to a direction of rotation of the presser plate, the presser plate having a leading surface presented toward the cylinder at an acute angle to a radius of the cylinder, wherein when not deflected by the presser plate, each warp thread passes inwardly of the cylinder in a straight line at an acute angle to vertical between a respective one of said guides and the top of a respective one of said needle tricks, without further guidance of the threads.

2. A machine as claimed in claim 1, wherein the said element is a horizontal disc mounted above and concentric with the cylinder, said guides being eyelets having substantially vertical axes and being formed near the periphery of the disc.

3. A machine as claimed in claim 2, wherein the eyelets lie on a circle of greater diameter than the cylinder.

4. A machine as claimed in claim 1, wherein at least one of said acute angles is approximately 5°.

5. A machine as claimed in claim 1, wherein a latch guard is provided and positioned to obstruct closing movement of a latch of an ascending needle just after the latch has cast off onto the stem of the needle a previously formed loop.

6. A machine as claimed in claim 5, wherein the latch guard is constructed of wire.

7. A machine as claimed in claim 5, wherein the latch guard moves with the presser plate and extends forwardly therefrom in the direction of rotation of the presser plate a distance such that when the pressure plate is deflecting a warp thread around a descending needle a leading end of the latch guard will obstruct closure of the latch of a rising needle the latch of said rising needle having just cleared a previously formed loop.

8. A machine as claimed in claim 7, wherein the presser plate is mounted on top of a column extending vertically from and movable with a cam box included in said cam means and the latch guard is supported below the presser plate by columns mounted upon the same said cam box.

9. A machine as claimed in claim 8, wherein the latch guard is arcuate, an arc defined by the latch guard lying on a circle concentric with the cylinder.

10. A machine as claimed in claim 5 and comprising at least one additional latch guard spaced vertically from another of said latch guards.

* * * * *